US005329864A

United States Patent [19]

Doring

[11] Patent Number: 5,329,864

[45] Date of Patent: Jul. 19, 1994

[54] DOOR OR WALL REINFORCING FILLER ASSEMBLY

[76] Inventor: Erich Doring, Im Holzeli, CH-9442 Berneck, Switzerland

[21] Appl. No.: 979,242

[22] Filed: Nov. 20, 1992

Related U.S. Application Data

[62] Division of Ser. No. 441,998, Nov. 28, 1989, Pat. No. 5,188,040.

[30] Foreign Application Priority Data

Dec. 1, 1988 [DE] Fed. Rep. of Germany ..... 3840497

[51] Int. Cl.[5] ..... E06B 9/00

[52] U.S. Cl. ..... 109/49.5; 109/80; 109/82; 109/84

[58] Field of Search ..... 109/24, 49.5, 64, 80, 109/82–85

[56] References Cited

U.S. PATENT DOCUMENTS

| | | | |
|---|---|---|---|
| 1,282,752 | 10/1918 | Carrino | 109/49.5 |
| 3,179,553 | 4/1965 | Franklin | 109/49.5 X |
| 3,648,613 | 3/1972 | Cunn | 109/49.5 X |
| 4,049,864 | 9/1977 | Hoover et al. | 109/82 X |
| 4,158,338 | 6/1979 | Dippold et al. | 109/83 X |
| 4,292,882 | 10/1981 | Clausen | 109/49.5 X |
| 4,323,000 | 4/1982 | Dennis et al. | 109/84 X |
| 4,325,309 | 4/1982 | King et al. | 109/49.5 |
| 4,732,803 | 3/1988 | Smith, Jr. | 109/80 X |
| 4,822,657 | 4/1989 | Simpson | 109/80 X |
| 4,879,165 | 11/1989 | Smith | 109/49.5 X |
| 5,050,507 | 9/1991 | Shoyat | 109/83 |
| 5,188,040 | 2/1993 | Doring | 109/49.5 |
| 5,196,252 | 3/1993 | Harpell | 109/80 X |
| 5,200,256 | 4/1993 | Dunbar | 109/49.5 X |

FOREIGN PATENT DOCUMENTS

| | | | |
|---|---|---|---|
| 2205498 | 8/1973 | Fed. Rep. of Germany | 109/83 |
| 577785 | 5/1946 | United Kingdom | 109/84 |

*Primary Examiner*—Peter M. Cuomo
*Assistant Examiner*—Suzanne L. Dino
*Attorney, Agent, or Firm*—Brown, Martin, Haller & McClain

[57] ABSTRACT

A break-in obstructing, or burglarproof door or wall, for which old motor vehicle tires are used as filling units instead of steel structures and sheeting. The treads or strips separated from the tires form mat-like, layered, and/or stacked filling units for burglarproof doors or walls and are connected with each other and to the frame by special fastening devices. This application considerably reduces the weight of such a door, and allows for burglarproof and break-in obstructing doors and walls at a much lower production cost, due to using recycling material.

13 Claims, 4 Drawing Sheets

DOOR OR WALL REINFORCING FILLER ASSEMBLY

Figure 1:
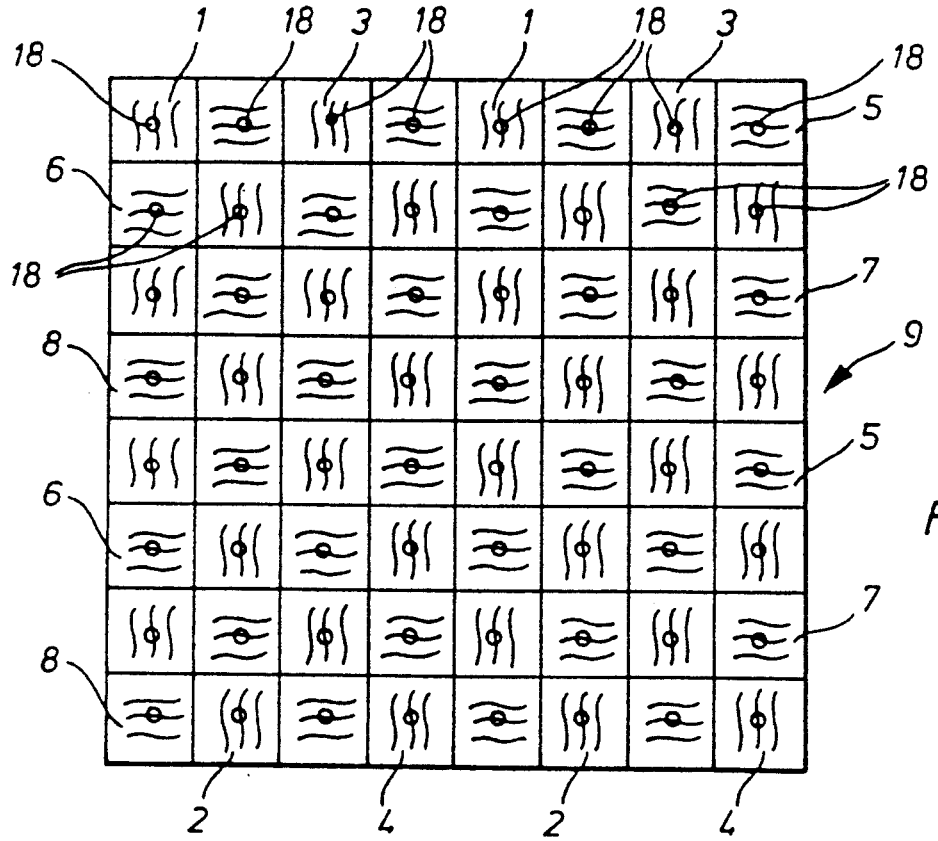

This is a divisional of application Ser. No. 07/441.998, filed Nov. 28, 1989, now U.S. Pat. No. 5,188,040.

The present invention relates generally to reinforced or burglar-resistant doors and wall for obstructing break ins, and is particularly concerned with a filler assembly for reinforcing a door or wall.

Such doors or walls obstructing break-in or being burglarproof are actually known. Steel structures or wood or aluminum sheeting is used to provide the Security for the doors or wall frames, which has certain disadvantages.

For one the use of such steel structures is relatively expensive and the door furthermore is very heavy, which calls for adequate strong fastenings and door frame units with a corresponding anchoring, which again is very costly. In addition to that bulletproof steel plate sheeting increases the weight as well as the expenditure.

According to relevant criteria a door is considered burglarproof, if it is not possible to cut an opening within 30 min by using a flex-grinder. An additional condition is that the above steel structure has such small openings, so that there would not be a possibility to get through the filling.

To provide doors or walls with all those burglarproof and break-in obstructing features, according to the conventional designs, is consequently relatively work intensive and expensive.

It is this invention's task to further develop the break-in obstructing doors or walls with less expensive materials as well as lower production costs while still meeting and ensuring the same if not a better protection against break-in.

The invention solves this task by using treads of old motor vehicle tires as a filling, which are cut to length, set in one or more layers, and connected with each other and to the door or wall frame.

Not only does this application reduce the weight of the door or wall element considerably, but it also uses material such as old tires, which to a great part can come to new use without reconditioning.

One design, for example, provides for reused treads, used in full width or cut lengthwise, which are then interlaced crosswise with other treads to form a mat-like mesh which is to be used as the filling for a door or a wall. Rivets, screws and/or clamping devices serve as bore-proof fastening devices, which connect the treads with the frame structure of the door or wall as well as with each other.

A further developed design based on the above design according to the invention provides additionally that the treads arranged parallel form the first layer or sheet, and the treads arranged crosswise form the second layer or sheet. The areas of crossing of corresponding strips are connected to each other and to the door or wall structure by undetachable fastening devices.

These relatively simple designs of a filling for doors or walls which obstructs break-in according to the invention, already show the possibility of using material such as old motor vehicle tires, which would otherwise not be usable, to obtain a break-in obstructing filling in accordance with the invention. Additionally a considerable decrease in weight can be obtained as well as a decrease in production cost due to using recycled material. Even the simple designs according to the invention, such as the mat-like or layered door or wall filling, can meet all the requirements, since welding through would not be possible due to the extensive generation of smoke and heat and because the torch flame would cause further vulcanization. A flex-grinder can practically also not be used, since the rubber material contained in the tire tread immediately fills the flex-blade so that there would be no cutting effect only a generation of heat and a further vulcanization.

Another design according to the invention offering even more security, provides for a number of treads or strips layered on top of each other and connected with fastening devices to form a stack, which serves as a filling for a door or a wall and which in turn is connected to the door or wall frame by undetachable fastening devices, and the thickness of which corresponds to the width of the treads or strips.

Yet another design providing even more security is distinguished by the first number of treads layered and connected to form the first stack and another number of treads layered and connected to the second stack, and both of them forming a two-layer filling for a door or wall. In this case the layering of the first stack is at a right angle to the layering of the second stack.

The fastening devices for these stacks can be screw bolts or similar connecting devices, which pass through the stack along the closing strip, however, not in one line, but arranged off-center.

The invention further provides that the fastening devices which connect the treads of each stack, such as screw bolts or similar devices, also show fastening devices, which are shorter and connect the layered strips passing through them off-center and overlapping each other.

The wall thickness as well as the design can certainly be varied in form of different combinations. The interweaved mat-like design can be combined with the two-layer design, whereby the strips of the two layers can be arranged diagonally to the door and wall frame. The mat-like and/or the parallel arranged treads or strips can further be combined with the stacks of treads. In this case mat-like interweaved and/or layered strips serve as a layer on the outside of stacks or inside the stacks or in between two stacks. These combinations allow for any desirable wall thickness.

To further improve the security of the designs according to the invention, the treads used as a filling for the door or wall can be treads from steel belted tires.

The invention also provides for an additional fastening of the strips, layers and stacks by means of vulcanization and gluing etc..

All the above designs have the advantage over conventional break-in obstructing and burglarproof doors or walls, that the filling units are considerably lighter, and that material is used, which otherwise could not be recycled, and which in turn substantially reduces the production and material costs.

Further details and features are apparent from following descriptions referring to the drawings.

Drawings show:

FIG. 1: a design of a door or wall filling according to the invention, with mat-like interweaved treads or strips.

Figure 2:
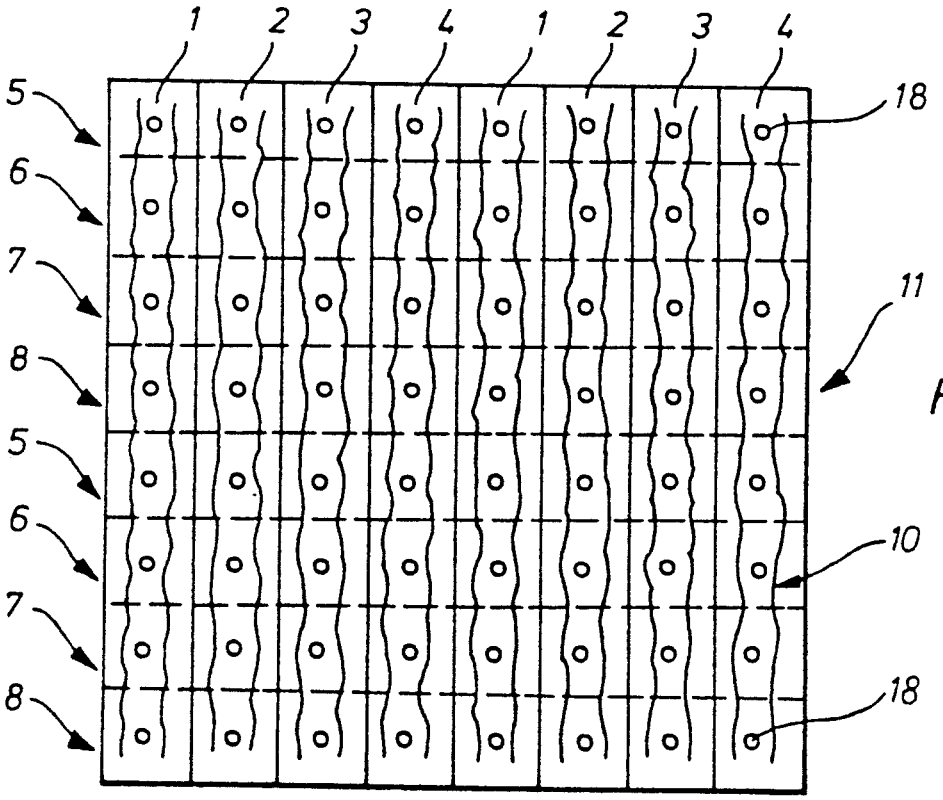

FIG. 2: a different design, which provides for two layers of treads arranged parallel; the strips of the layers are arranged crosswise.

Figure 3:
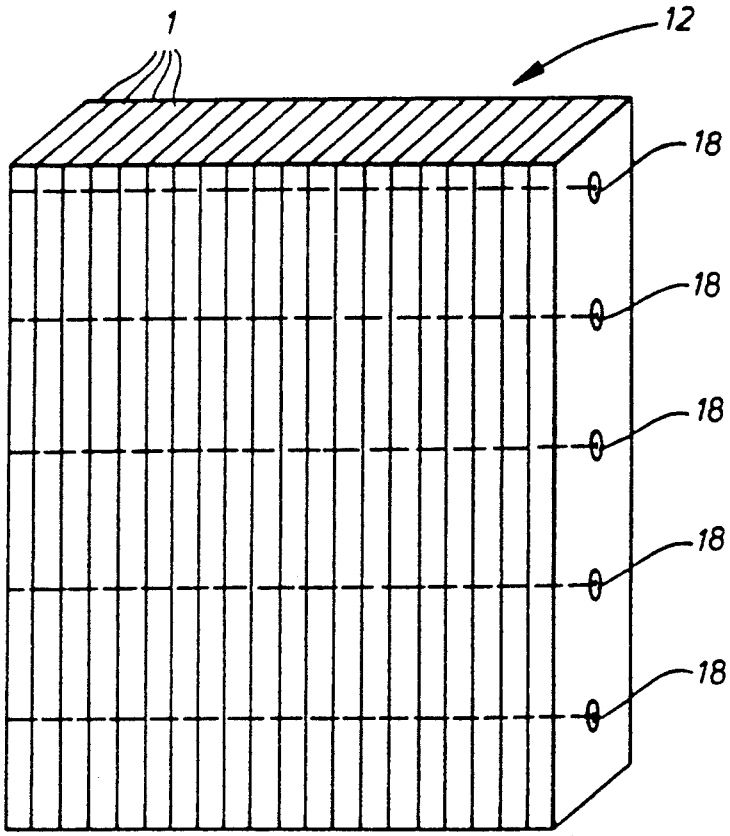

FIG. 3: a design according to the invention, in which the treads or strips are layered and form a stack which serves as a filling.

Figure 4:
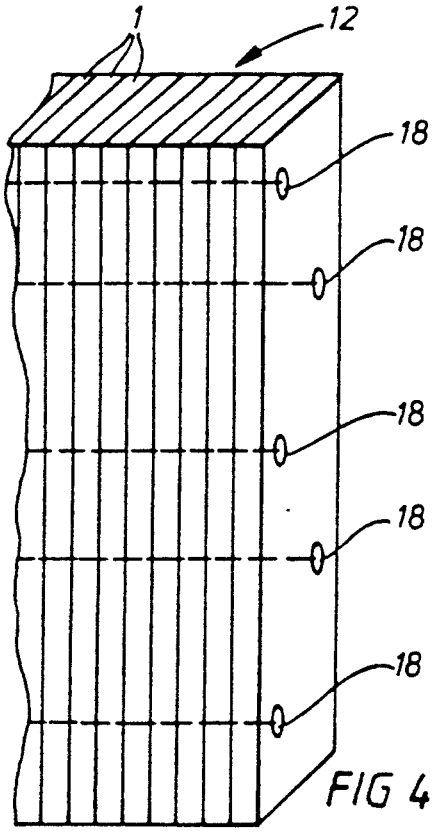

FIG. 4: arrangement of the fastening devices passing through the stack off-center.

Figure 5:
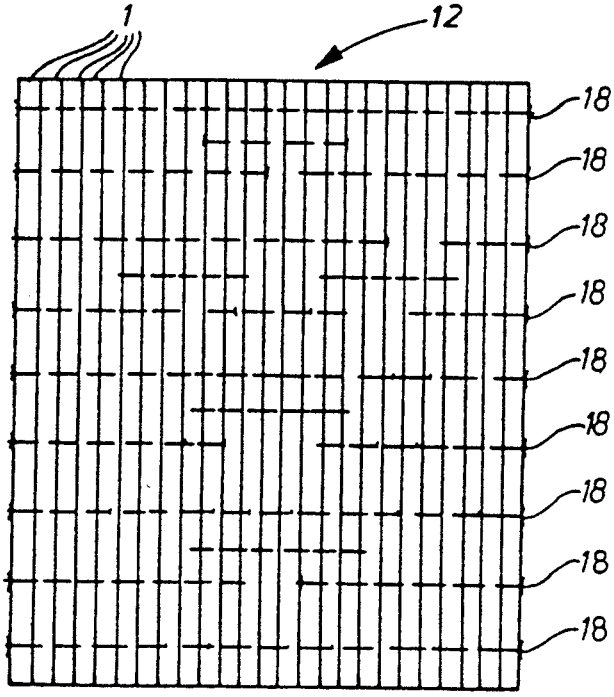

FIG. 5: arrangement of fastening devices only partially passing through the entire stack.

Figure 6:
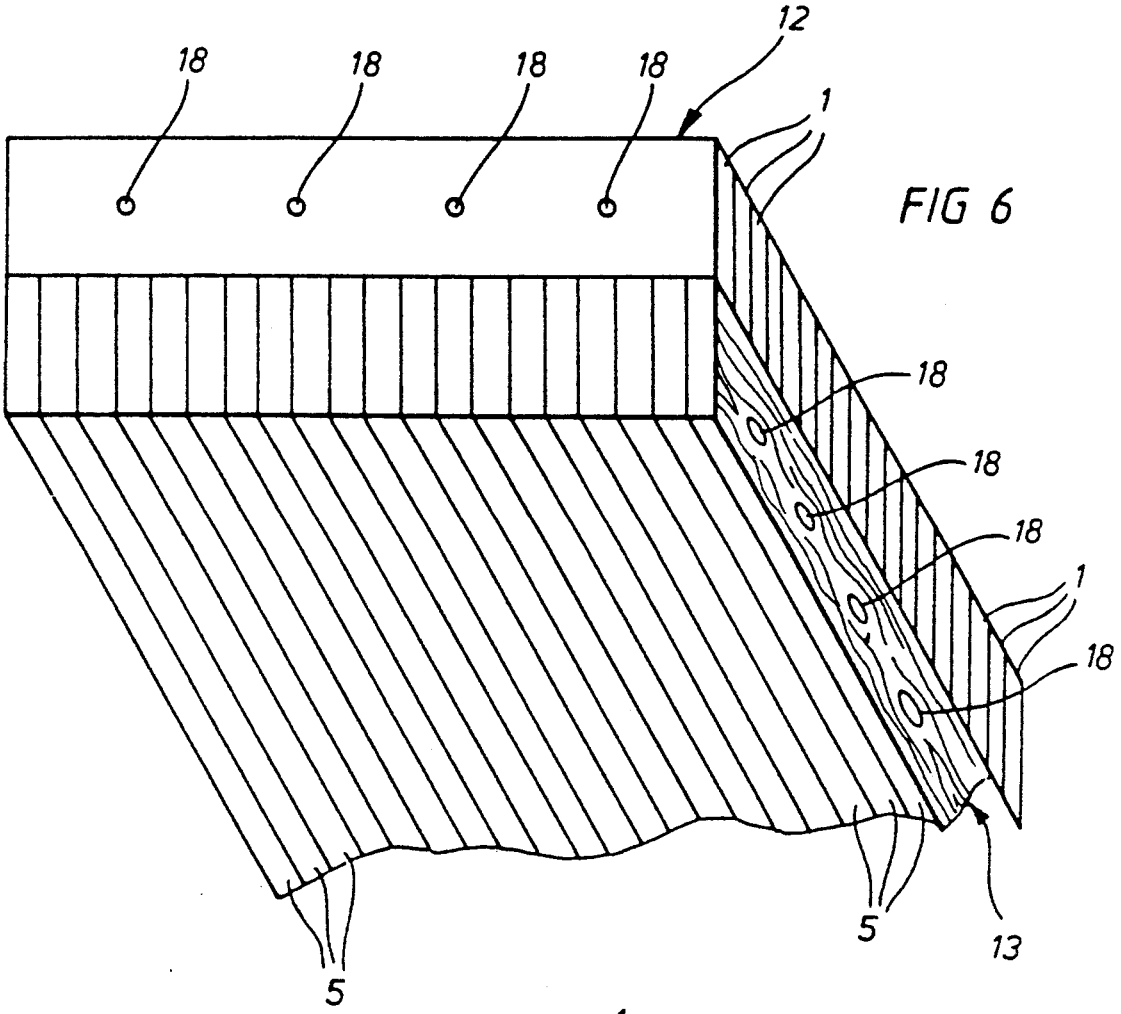

FIG. 6: a filling unit for a door or a wall consisting of two stacks of treads or strips.

Figure 7:
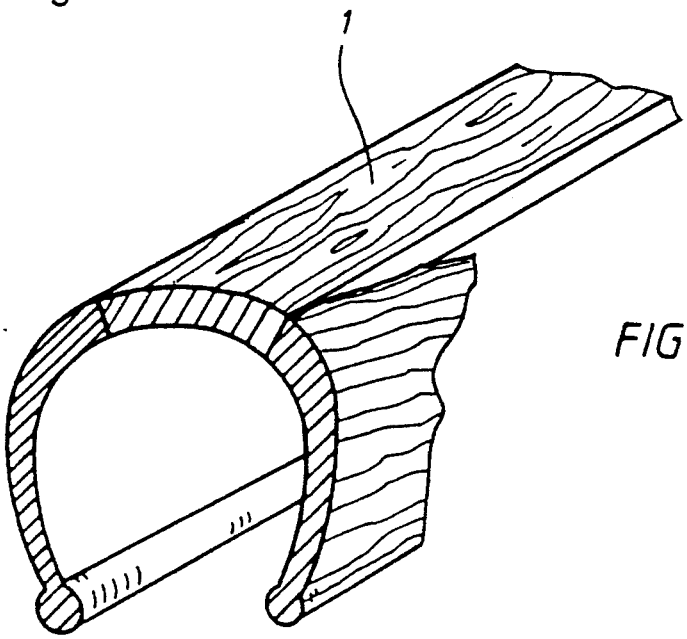

FIG. 7: the schematic cross section of an old steel belted tire, showing the line of cutting for separating the tread.

Figure 8:
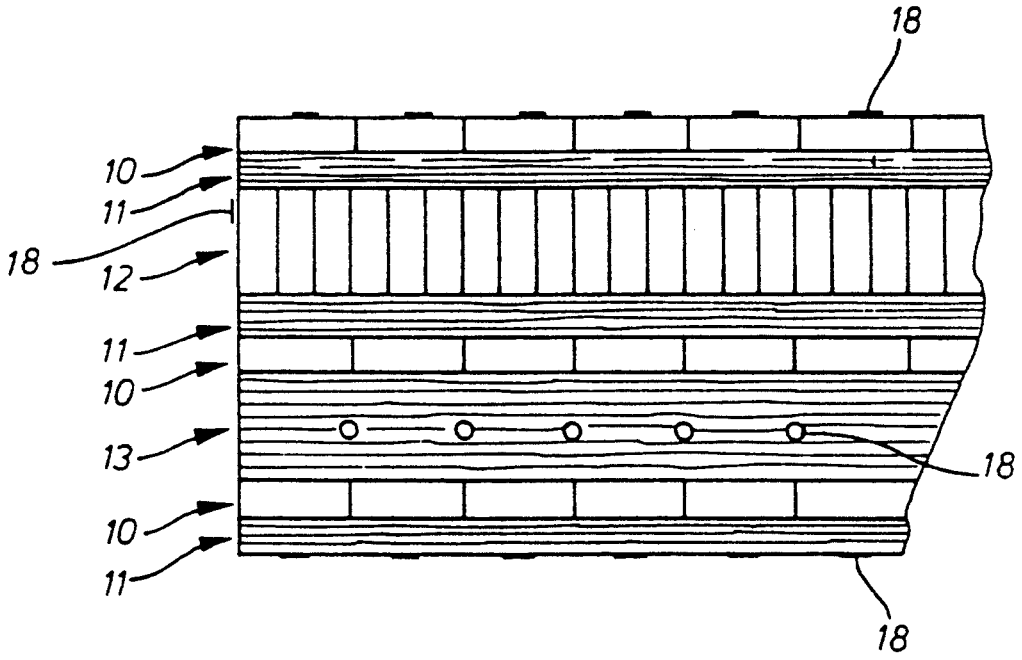

FIG. 8: a schematic depiction of a possible combination.

FIGS. 1 to 6 show basic designs of filling units according to the invention for a door or wall obstructing break-in, using old tire treads.

FIG. 1 depicts a design of a mat-like mesh 9 consisting of treads; the tread strips 1,2,3,4, are interweaved with more strips 5,6,7,8 at a right angle or crosswise as to form a filling unit which fills a door or a wall. The mat-like filling unit can certainly have any other geometric shape and be fitted into the frame. The filling unit is connected to the door or wall frame with suitable fastening devices, such as bore-proof screws, rivets, which are not accessible from the break-in direction, and with clamping devices on the side of the frame. As apparent from FIG. 1 the vertically arranged treads 1,2,3,4 are fastened to the horizontally arranged treads 5,6,7,8 at their cross section by bore-proof fastening devices 18, such as screws and rivets.

It has to be pointed out that a further advantage, which is characteristic of this invention in regards to the application of old tires as filling units obstructing break-in, is that a forced access to the fastening devices as well as the forced detaching, severing or separating of fastening devices in the area of the door or wall frame or in the area of the connection of strips, layers, or stacks has to occur by using heat generating tools, which, as mentioned in the beginning, prevents manipulation due to the interference with smoke, gases, and re-vulcanization.

FIG. 2 shows a second design of a flat filling unit, which provides for a parallel arrangement of treads in two layers. It is apparent from FIG. 2 that the treads 1,2,3, and 4, running vertically, form the upper layer or sheet 10, while the second layer or sheet 11 underneath shows the treads 5,6,7, and 8, which are arranged crosswise or at a right angle to the treads of the first layer.

These two layers are connected by corresponding fastening devices 18 at the respective crossing of the strips, 1 with 5, 2 with 5, 3 with 5, 4 with 5, and 1 with 6 and so on.

FIG. 3 depicts yet another design of a filling unit for a door or wall obstructing break-in. In this case a number of strips 1 are layered as to form a stack 12 and connected with each other by e.g. screw bolts. It is apparent from this drawing that such a block of strips 1 can be as thick as the wall, which corresponds to the maximum width of the tread of an old tire. To enhance obstruction the screw bolts 18, as depicted in FIG. 4, can pass through the stack off-center, or as depicted in FIG. 5, the screw bolts 18 can vary in length. In this case some of the bolts would pass through the entire stack 12 and some shorter bolts would connect a few layers or sheets of the stack to a pack, while again different shorter screw bolts, arranged off-center and overlapping, hold the packs together.

Another filling unit based on the design of applying stacks 12 is depicted in FIG. 6. This unit consists of a first stack 12 and a second stack 13, whereby the layers of the strips 1 of the first stack 12 are arranged at a right angle to the layers of the strips of the second stack 13.

In order to further improve security the filling units according to the invention can be treads of steel belted tires, which can be used in all of the above mentioned designs. The position of the steel inlay of such tires is apparent from FIG. 7, which shows a tire profile with cutting lines for separating the tread.

FIG. 7 also depicts a tread 1 of the length of 1.8 meters and above, with a width of approximately 140 mm and a thickness of 10 to 15 mm.

Longer treads, for higher and wider doors and walls, can certainly be obtained for example by an overlapping arrangement of layers, stacks etc. so that there are no limits set.

There are also no limits in regards to the wall thickness of a filling unit for all designs according to this invention. For example more stacks 12,13, as shown in FIG. 6, can be used. There is as well the possibility of combining the stacks 12,13 of FIG. 6 with e.g. two flat filling units, as in FIG. 2, on either side of the stacks and/or in between them. The touching layers of the stacks 12,13 as in FIG. 6 are arranged at a right angle to the layers or sheets 10,11 as in FIG. 2. This arrangement is depicted schematically, in a front view in FIG. 8. Other combinations are certainly also possible.

The treads and the filling units can additionally be held together, individually or combined, by vulcanization or gluing.

I claim:

1. A door or wall reinforcing filler assembly, comprising:

a reinforcing filler panel for fitting into the frame of a door or wall;

the panel comprising a first set of recycled motor vehicle tire tread strips arranged parallel to one another in a first direction, and a second set of recycled motor vehicle tire tread strips arranged parallel to one another in a second direction perpendicular to said first direction, said strips of said first and second sets comprising a plurality of separate, flat strips, and fastener means for fastening the strips together into at least one layer forming said filler panel, said fastener means extending transversely through strips in said first and second sets at spaced intervals; and securing means for securing the panel to a door or wall frame.

2. The assembly as claimed in claim 1, wherein the second set of strips are interwoven with the first set of strips to form a mat-like mesh.

3. The assembly as claimed in claim 1, wherein said fastener means comprises fasteners extending through the strips at spaced cross-over positions between the strips.

4. The assembly as claimed in claim 1, wherein said panel comprises at least two separate layers, a first layer comprising said first set of strips stacked on top of each other to form a first stack, said stack comprising one layer of said panel having a thickness equal to the width of a strip, and a second layer comprising said second set of strips stacked on top of each other to form a second stack at right angles to the strips in the first stack and said fastener means comprise fasteners extending transversely through each stack.

5. The assembly as claimed in claim 4, wherein the fasteners are off-center relative to the center line of the strips of each stack.

6. The assembly as claimed in claim 5, wherein the fasteners comprise elongate screw members of different lengths, each screw member connecting a number of layers in a respective stack together, and the screw members in each stack overlapping to provide a continuous, overlapping connection from one end to the opposite end of the stack.

7. The assembly as claimed in claim 1, wherein the recycled tire tread strips are steel belted tire tread strips.

8. The assembly as claimed in claim 1, wherein said fastener means comprise a plurality of screw fasteners securing said tire strips together to form a continuous mat.

9. The assembly as claimed in claim 8, wherein said fastener means further includes adhesive means for bonding said strips together.

10. The assembly as claimed in claim 4, wherein said panel further includes a mat layer of strips arranged side by side and secured together, the mat layer strips being arranged between said stacks of strips, and fastener devices extending transversely through the stacks and mat layer to hold the stacks and mat layer together.

11. The assembly as claimed in claim 10, wherein said panel comprises a plurality of alternating strip stacks and mat layers.

12. A door or wall reinforcing filler assembly, comprising:

a reinforcing filler panel for fitting into the frame of a door or wall;

the panel comprising a first set of recycled motor vehicle tire tread strips arranged parallel to one another in a first direction, and a second set of recycled motor vehicle tire tread strips arranged parallel to one another in a second direction perpendicular to said first direction, and fastener means for fastening the strips together into at least one layer forming said filler panel;

securing means for securing the panel to a door or wall frame; and said panel comprising two separate layers of strips, a first layer comprising said first set of strips arranged side by side and parallel to one another in a first direction, and a second layer comprising said second set of strips extending side by side and transverse to said first direction underneath the first set of strips, said fastener means comprising a plurality of fasteners extending transversely through both layers of strips at spaced intervals.

13. A door or wall reinforcing filler assembly, comprising:

a reinforcing filler panel for fitting into the frame of a door or wall;

the panel comprising a first set of recycled motor vehicle tire tread strips arranged parallel to one another in a first direction, and a second set of recycled motor vehicle tire tread strips arranged parallel to one another in a second direction perpendicular to said first direction, and fastener means for fastening the strips together into at least one layer forming said filler panel;

securing means for securing the panel to a door or wall frame;

the panel comprising at least two separate layers, a first layer comprising said first set of strips stacked on top of each other to form a first stack, said stack comprising one layer of said panel having a thickness equal to the width of a strip, and a second layer comprising said second set of strips stacked on top of each other to form a second stack at right angles to the strips in the first stack and said fastener means comprise fasteners extending transversely through each stack; and additional fastener means for securing the stacks together.

* * * * *